US005850984A

United States Patent [19]

Kleitz

[11] Patent Number: 5,850,984

[45] Date of Patent: Dec. 22, 1998

[54] MACHINE FOR CONTINUOUSLY UNWINDING BOBBINS COMPRISING AT LEAST ONE MEANS FOR SIMULTANEOUSLY UNWINDING TWO SIDE-BY-SIDE OR COAXIAL BOBBINS

[75] Inventor: Claude Kleitz, Strasbourg, France

[73] Assignee: Monomatic, Societe Anonyme, Strasbourg, France

[21] Appl. No.: 816,041

[22] Filed: Mar. 11, 1997

[30] Foreign Application Priority Data

Mar. 11, 1996 [FR] France ..... 96 03189

[51] Int. Cl.[6] ..... B65H 19/18

[52] U.S. Cl. ..... 242/555.5; 242/559.2

[58] Field of Search ..... 242/555, 555.5, 242/555.6, 555.7, 559.2

[56] References Cited

U.S. PATENT DOCUMENTS

| | | | |
|---|---|---|---|
| 3,062,467 | 11/1962 | Chase et al. | 242/555.5 X |
| 3,381,912 | 5/1968 | Huck | 242/555.5 X |
| 3,831,876 | 8/1974 | Phelps et al | 242/555.6 X |
| 3,944,151 | 3/1976 | Lee et al. | 242/555.6 |
| 4,196,866 | 4/1980 | Schaffner et al. | 242/559.2 |
| 4,233,104 | 11/1980 | Fujishima et al. | 242/555 X |
| 4,506,842 | 3/1985 | Beck | 242/555.6 X |
| 4,555,288 | 11/1985 | Nozaka | 242/555.6 X |

FOREIGN PATENT DOCUMENTS

| | | |
|---|---|---|
| 2 304 556 | 10/1976 | France . |
| 2 413 304 | 7/1979 | France . |

*Primary Examiner*—Donald P. Walsh
*Assistant Examiner*—William A. Rivera
*Attorney, Agent, or Firm*—Young & Thompson

[57] ABSTRACT

A machine for continuously unrolling, permitting simultaneous unrolling of two side-by-side or coaxial bobbins (1), comprises a chassis (2) on which are guided in rotation two plates (3) parallel to each other and connected by shafts (4 and 5) for the support and guidance of lateral bobbin-carrying arms (6) for the support and driving of bobbins (1), and an intermediate bobbin-carrying arm (7) for the simultaneous unrolling of two side-by-side or coaxial bobbins (1). The frame (2) is moreover provided with a device (8) for cutting and interconnecting ending strips and new bobbins. The intermediate bobbin-carrying arm (7) is articulated and retractable into a non-use position and the device (8) for cutting and connecting ending and new strips, comprises a device (12) for individual application of two ending strips, independently of each other, onto two new strips from bobbins that are side-by-side or coaxial, and for application of a single strip of great width to a single new bobbin (1), as well as a device (14) for cutting and connecting two strips individually and independently or a single strip of great width.

19 Claims, 4 Drawing Sheets

MACHINE FOR CONTINUOUSLY UNWINDING BOBBINS COMPRISING AT LEAST ONE MEANS FOR SIMULTANEOUSLY UNWINDING TWO SIDE-BY-SIDE OR COAXIAL BOBBINS

CROSS REFERENCE TO RELATED APPLICATIONS

This application corresponds to French application 96 03189 of Mar. 11, 1996, the disclosure of which is incorporated herein by reference.

FIELD OF THE INVENTION

The present invention relates to the field of machines for continuously unrolling strip material from bobbins to supply, particularly continuously, printing machines, cutters, gluers or other treatment machines, and has for its object a continuously unrolling machine comprising at least one means for unrolling two side-by-side or coaxial bobbins simultaneously.

The continuity of operation of unrolling strips, when one bobbin arrives at its end, is assured by connection at full speed of the terminal end of the strip to the new strip, this by means of a device for cutting and connecting on the fly, the connection being effected end to end or with overlap.

BACKGROUND OF THE INVENTION

Known unrolling machines generally permit unrolling of bobbins of great width, mounted by means of their mandrel on centering heads of bobbin-carrying arms mounted pivotally on supports that are rotatable and lockable in service position on the rotatable supports, and are, because of this fact, hardly adapted for unrolling narrow bobbins and, in particular, not for unrolling at least two bobbins of small width simultaneously.

To this end, it has been proposed to provide existing machines with an intermediate bobbin-carrying arm, provided with centering heads adapted to coact with the mandrels of two bobbins and mounted on a central rotatable shaft for the supports of the lateral bobbin-carrying arms. This intermediate bobbin-carrying arm is mounted on a central shaft with the ability to slide for its positioning for reception of bobbins or for its lateral withdrawal in the case of non-use and its centering heads extend at a distance from the axis of the central shaft equal to that of the centering heads of the lateral bobbin-carrying arms, in a pivoted and locked service position of these latter.

Such an arrangement permits unrolling simultaneously two strips from two separate bobbins and the lateral withdrawal of the intermediate support arm, in its rest position. However, the intermediate bobbin-carrying arm is rigid and accordingly does not permit spacing of its centering heads relative to the central shaft, such that a gripping of the bobbins cannot be effected. Thus, the bobbins must be brought with their mandrels opposite the centering heads of the lateral bobbin-carrying arms and of the intermediate arm by means of an elevating handling device to be able to be gripped by introduction of the heads in the mandrels.

In the case of such use, the cutting and connection between the ending strip and the new strip are effected by means of the cutting and connection device provided for normal use of the machine. As a result, if bobbins of different diameters must be unrolled simultaneously, the strips of these latter cannot be cut and connected during operation, but require, to do this, stopping the machine and manual cutting and connecting.

Moreover, the pivoting lateral bobbin-carrying arms of the existing machines have limits as to the raising or gripping of heavy loads in the form of bobbins of very high capacity, in particular as to their rigidity.

SUMMARY OF THE INVENTION

The present invention has for its object to overcome these drawbacks by providing an unrolling machine permitting unrolling simultaneously two bobbins as well as their direct gripping, without specific raising means. Moreover, the cutting and connection of the ending strips with new strips must be rendered possible separately, even in the case of bobbins of different diameter.

According to the invention, the unrolling machine permitting simultaneous unrolling of two bobbins, which is essentially constituted by a frame, on which are guided in rotation two plates or discs that are parallel to each other and connected by means of support and guidance shafts of lateral bobbin-carrying arms for the support and driving of the bobbins and by an intermediate bobbin-carrying arm for simultaneously unrolling two side-by-side or coaxial bobbins, the chassis being provided moreover with a cutting and connection device between the ending strips and new bobbins, is characterized in that the intermediate bobbin-carrying arm is articulated and retractable in non-use position and in that the cutting and connection device between the ending strips and new bobbins comprises means for individual application of two ending strips, independently of each other, to two new side-by-side or coaxial bobbins and the application of a single band of great width on only a new bobbin, as well as means for cutting and connecting two individual or independent strips or a single band of great width.

BRIEF DESCRIPTION OF THE DRAWINGS

The invention will be better understood from the following description, which relates to a preferred embodiment, given by way of non-limiting example, and explained with reference to the accompanying schematic drawings, in which.

DETAILED DESCRIPTION OF THE INVENTION

Figure 1:
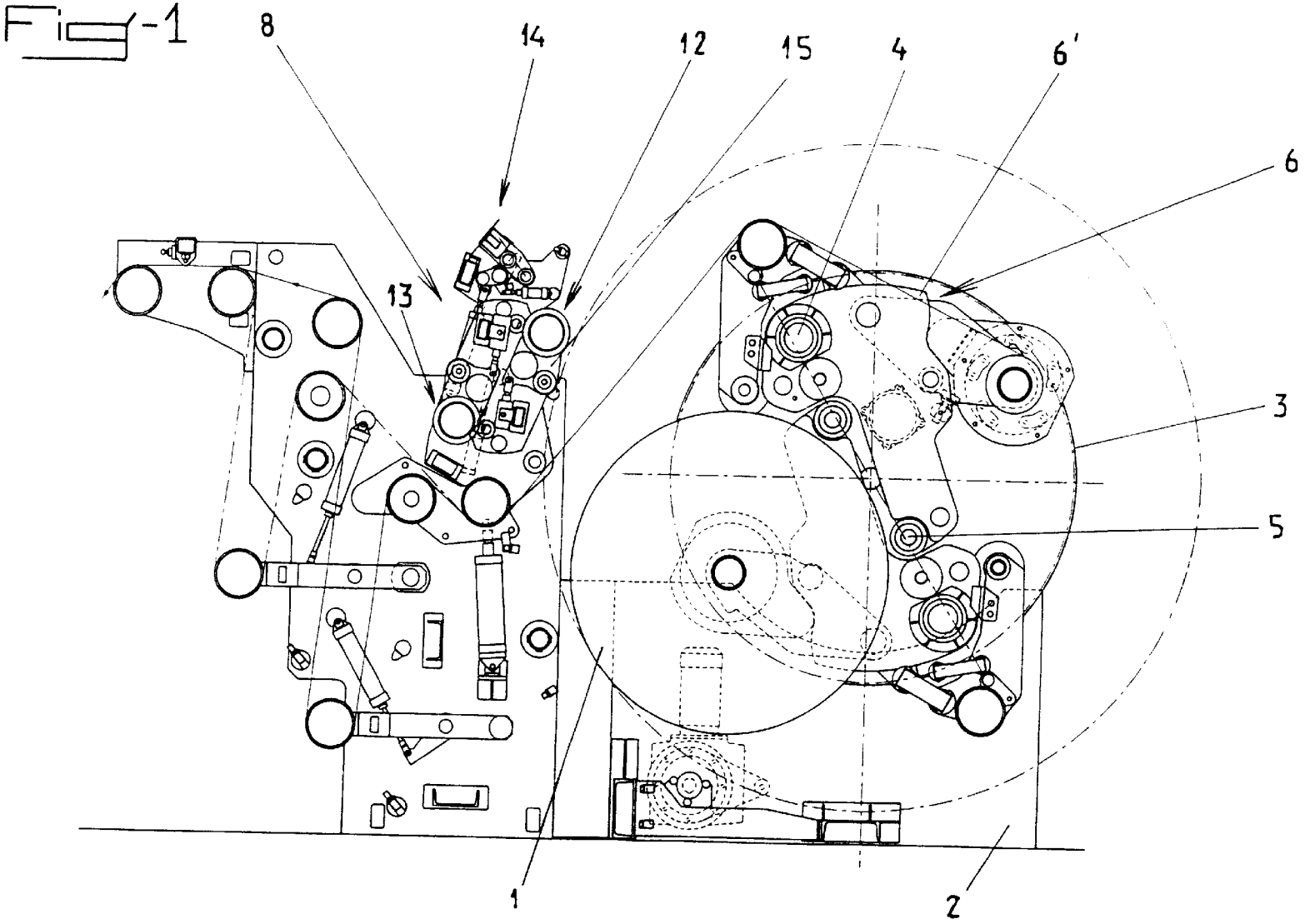
FIG. 1 is a side elevational and cross-sectional view of an unrolling machine according to the invention.
Figure 4:
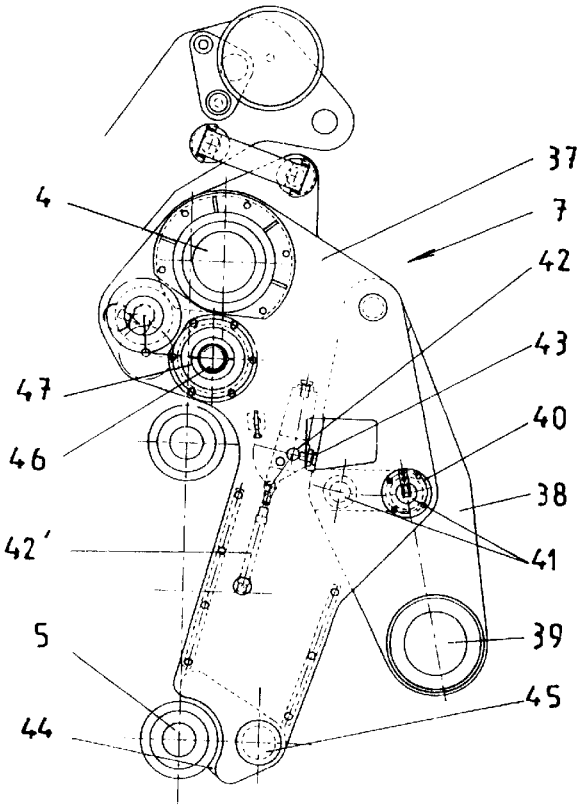
FIG. 4 is a side elevational view of the intermediate bobbin-carrying arm for two side-by-side or coaxial bobbins.

FIG. 1 of the accompanying drawings shows a machine for continuous unrolling permitting simultaneous unrolling of two bobbins 1, which is essentially constituted by a frame 2, on which are guided in rotation two plates or discs 3 parallel to each other and connected by means of shafts 4 and 5 for support and guidance of lateral bobbin-carrying arms 6 for support and driving of bobbins 1 and as shown in FIG. 4 an intermediate bobbin-carrying arm 7 for simultaneous unrolling of two side-by-side or coaxial bobbins 1, the chassis 2 being provided moreover with a device 8 for cutting and connecting between ending strips and new bobbins. This device 8 as depicted in FIG. 2 is mounted pivotally on the frame 2 by means of lateral support arms 9 and pivots 10, the arms 9 being actuated each by a jack 11.

According to the invention, the intermediate bobbin-carrying arm 7 is articulated and retractable in non-use position and the device 8 for cutting and connecting between ending strips and new bobbins comprises means 12 for the individual application of two ending strips, independently of each other, to new side-by-side or coaxial bobbins 1, and 13 for application of a single strip of great width to a new single bobbin, as well as means 14 for cutting and connecting two strips individually and independently or of a single strip of great width.

Figure 2:
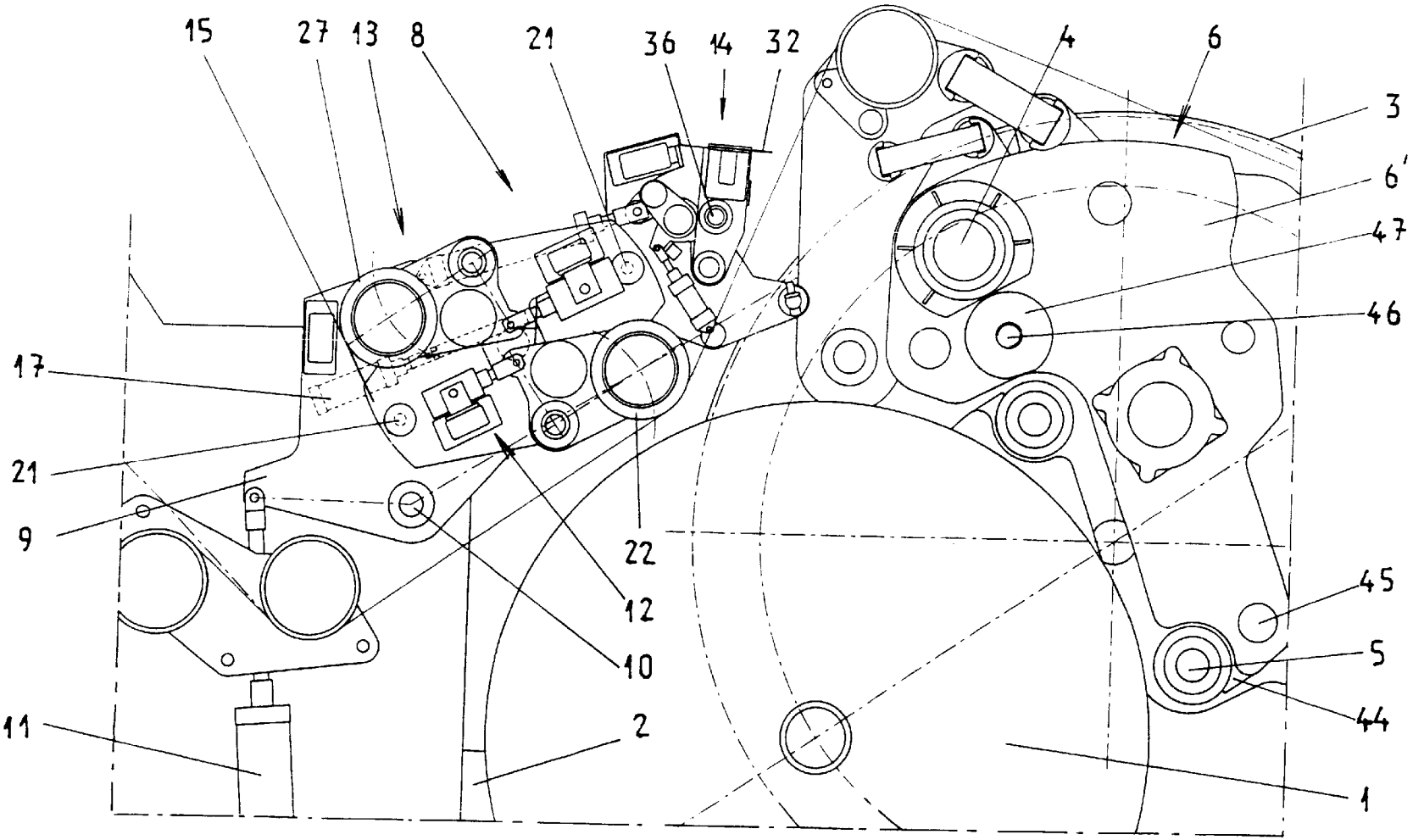
FIG. 2 is a side elevational view, on a larger scale, of the device for cutting and connecting between an ending strip and a new bobbin.
Figure 3:
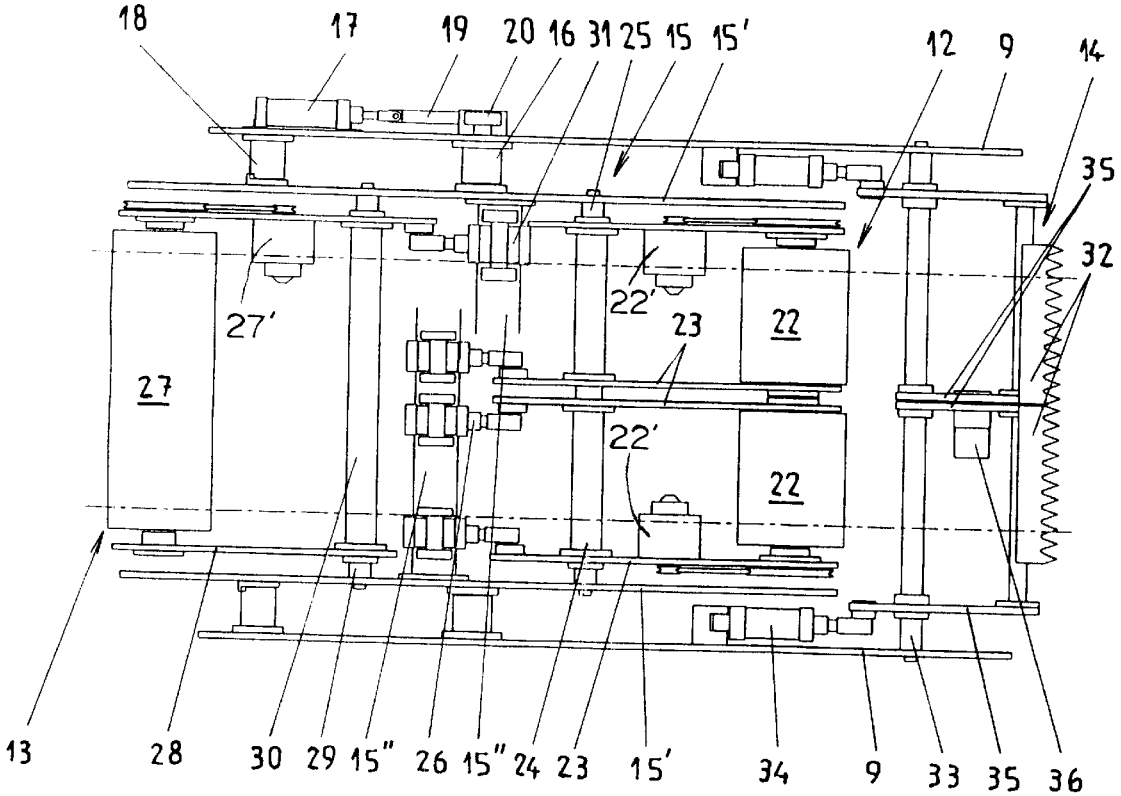
FIG. 3 is a plan view of the cutting and connecting device.

The means 12 for individual application of two ending strips, independently of each other, to two new side-by-side or coaxial bobbins 1, and 13 for application of a single strip of great width to a new single bobbin, are mounted symmetrically, as shown more particularly in FIGS. 2 and 3 of the accompanying drawings, in an assembly of a rotatable support 15 guided between the lateral support arms 9 by means of hubs 16 and actuated in rotation by a device 17, by indexing means 18 maintaining the assembly of the rotatable support 15 in its service positions. This rotatable support assembly 15 is constituted by two plates 15' each secured to a hub 16 and interconnected by a pair of cross-members 15" disposed symmetrically relative to the hubs 16 for guidance in rotation of the rotatable support 15 on the lateral support arms 9.

According to one characteristic of the invention, the device 17 for actuating in rotation is constituted by at least one jack provided on its piston rod with a rack 19 coacting with a pinion 20 provided on the corresponding hub 16, the jack being mounted by its cylinder on the corresponding lateral support arm 9 (FIGS. 2 and 3). This device 17 for actuating in rotation can also be constituted by a motor reductor assembly, of a rotatable jack or the like directly connected to the hub 16 and mounted on the corresponding lateral support arm 9.

The indexing means 18 is preferably in the form of a bolt mounted on the internal surface of at least one of the lateral support arms 9 and coacting with holes 21 of corresponding cross section provided in the plate 15' corresponding to the rotatable support assembly 15. This indexing means 18 preferably comprises two holes 21 diametrically opposed on the plate 15'. Thus, it is possible to obtain two locking positions of the support 15 corresponding to the service positions of the means 12 for individual application of two ending strips, independently of each other, on two new side-by-side or coaxial bobbins 1 and 13 for the application of a single strip of great width on a single new bobbin. As a result, it suffices simply to actuate the device 17 to bring, by means of the support 15, the means 12 for individual application of two ending strips, independently of each other, onto two new side-by-side or coaxial bobbins 1 or 13 for the application of a single strip of great width on a single new bobbin, in service position.

The means 12 for individual application of two ending strips, independently of each other, onto two new side-by-side or coaxial bobbins 1, is shown more particularly in FIG. 3 of the accompanying drawings and is constituted by two cylinders 22 each mounted at the end of two interconnected pivoting levers 23, at the opposite end from the cylinders 22, by means of a guiding and pivoting sleeve 24 on a shaft 25 secured at its ends with the plates 15' of the rotatable support assembly 15 and by at least one means 26 for pivotally actuating each cylinder 22 individually, acting on at least one lever 23 of each pair of pivoting levers 23. Thus, each cylinder 22 can be independently maneuvered for the application of the corresponding strip for the operation of connecting, in synchronism with the means 14 for cutting and corresponding connection. In the illustration of FIG. 3 of the accompanying drawings, the means 12 for individual application of two ending strips are in service position.

The means 13 for application of a single strip of great width on a single new bobbin, also represented in FIG. 3 of the accompanying drawings, is present in the form of a single cylinder 27 guided between the ends of two levers 28, mounted pivotally on a shaft 29, secured at its ends to the plates 15', by means of a sleeve 30 connecting the levers 28 to each other at their opposite end to that carrying the single cylinder 27, a means 31 for actuating pivotally the single cylinder 27 acting on at least one pivoting lever 28 (FIG. 3). This means 13 permits, in the service position, the application of a strip of great width on a single bobbin for the connection operation.

The means 26 and 31, respectively for actuation pivotally of each cylinder 22 individually and for actuation pivotally of the single cylinder 27, are preferably in the form of jacks, whose piston rod is articulated on the corresponding lever 23 or 28, in an eccentric manner relative to the corresponding pivotal guide shaft 25 or 29, and whose cylinder is mounted on a cross member 15" of the rotatable support 15. The cross member 15" associated with each jack is preferably that located on the side of the rotatable support 15 opposite that carrying the shaft 25 or 29 for pivotal guidance of the corresponding lever or levers 23 or 28 (FIGS. 2 and 3).

In a known manner, the individual cylinders 22 and single cylinder 27 are connected, by belt and pulley drive means or the like, each to a corresponding starting motor 22' and 27'. These starting motors are adapted to impart to the corresponding cylinders 22 and 27 a tangential speed equal to the linear speed of the ending strips, for connection on the fly in continuous operation.

The means 14 for cutting and connecting two strips individually and independently or a single strip of great width, are essentially constituted by two transverse knives 32 mounted pivotally on a transverse shaft 33, whose ends are fixed on the lateral support arms 9, for pivoting on the frame 2, and by a pivoting actuator 34 for each knife 32 individually (FIG. 3) . The knives 32 extend preferably each over half the maximum width of the strip that can be unrolled and are each mounted on the transverse shaft 33 for pivoting by means of arm 35, of which those located on the side of the lateral support 9 are each connected to an independent pivoting actuator 34 in the form of a jack or the like, the opposite arms 35 being adjacent, the same for the internal edges of the knives 32.

So as to be able to provide a cut perfectly synchronized, of a strip of great width, by simultaneous operation of two transverse knives 32, the means 14 for cutting and connection are provided with a device 36 for locking the transverse knives 32 in alignment. This device 36 is preferably constituted by a bolt actuated by a jack mounted on one of the adjacent arms 35, the bolt coacting in service position with a recess of corresponding shape on the other adjacent arm.

Such an arrangement of knives 32 permits, in the locked position, carrying out the cutting of a single strip of great width, whilst the triggering of the device 36 permits individual operation of each knife 32 by means of the corresponding actuator 34.

The intermediate bobbin-carrying arm 7, which is shown more particularly in FIG. 4 of the accompanying drawings, is constituted by a guide element 37 on the shafts 4 and 5 for support and guidance of the lateral bobbin-carrying arms 6 for supporting and driving the bobbins 1 and by a pivoting lever 38, articulated on the guide element 37 at one of its ends and having, on opposite sides of its free end, two centering heads 39 for insertion in the mandrels of bobbins.

The element 37 for guidance on shafts 4 and 5 for support and guidance of the lateral bobbin-carrying arms 6 for support and driving of bobbins 1, is provided with a locking means 40, respectively in position for support of bobbins of small width and in withdrawn position of the pivoting lever 38 (FIG. 4). To this end, the locking means 40 is constituted by a jack, mounted on the guide element 37 on the shafts 4 and 5 for support and guidance of the lateral bobbin-carrying arms 6 and whose piston rod coacts, in its two service positions, with recesses 41 of corresponding shape provided in the pivoting lever 38, the retracted positions and support positions of the bobbins being defined by an abutment 42 pivoting to two positions, actuated by a jack 42', of the guide element 37 coacting with a fixed abutment 43 of the pivoting lever 38 (FIG. 4).

Thus, for taking up simultaneously two bobbins 1, the locking means 40 is triggered, such that the pivoting lever 38 can swing freely during rotation of the plates or discs 3 also bringing the lateral bobbin-carrying arms 6 for support and driving of the bobbins 1 into the gripping position. In the course of the following raising maneuver, the lever 38 pivots parallel to the lateral bobbin-carrying arms 6 and, arriving at the end of the lifting path, it is locked in support position for the bobbins by means of locking means 40 coacting with the corresponding recess of the lever 38 (FIG. 4).

For retracting the lever 38, the pivoting of this latter is pursued, after pivoting of the pivoting abutment 42 by means of its actuating jack 42', so as to free the passage of the fixed abutment 43, for example by swinging to the right of the abutment 42 (FIG. 4).

According to another characteristic of the invention and as shown in FIGS. 1, 2 and 4 to 6 of the accompanying drawings, the lateral bobbin-carrying arms 6 for support and drive of the bobbins 1 as well as the intermediate bobbin-carrying arm 7, are mounted directly on one, 4, of the support and guidance shafts, by means of their guide element 6' and 37, and are connected to the other support and guide shaft 5 by means of a mobile device 44 articulated by a pin 45 on the corresponding end of the guide element 6' and 37, a screw-threaded shaft 46, secured at its ends to the parallel plates or discs 3, being guided moreover in the guide element 6' and 37 and coacting with a motorized screw 47 for movement of the arms 6 and 7.

Thanks to this arrangement of arms 6 and 7, it is possible to obtain a very great rigidity of the arms 6 and 7 and thus to be able to carry out raising of very heavy loads, which is impossible with devices now existing.

Figure 5:
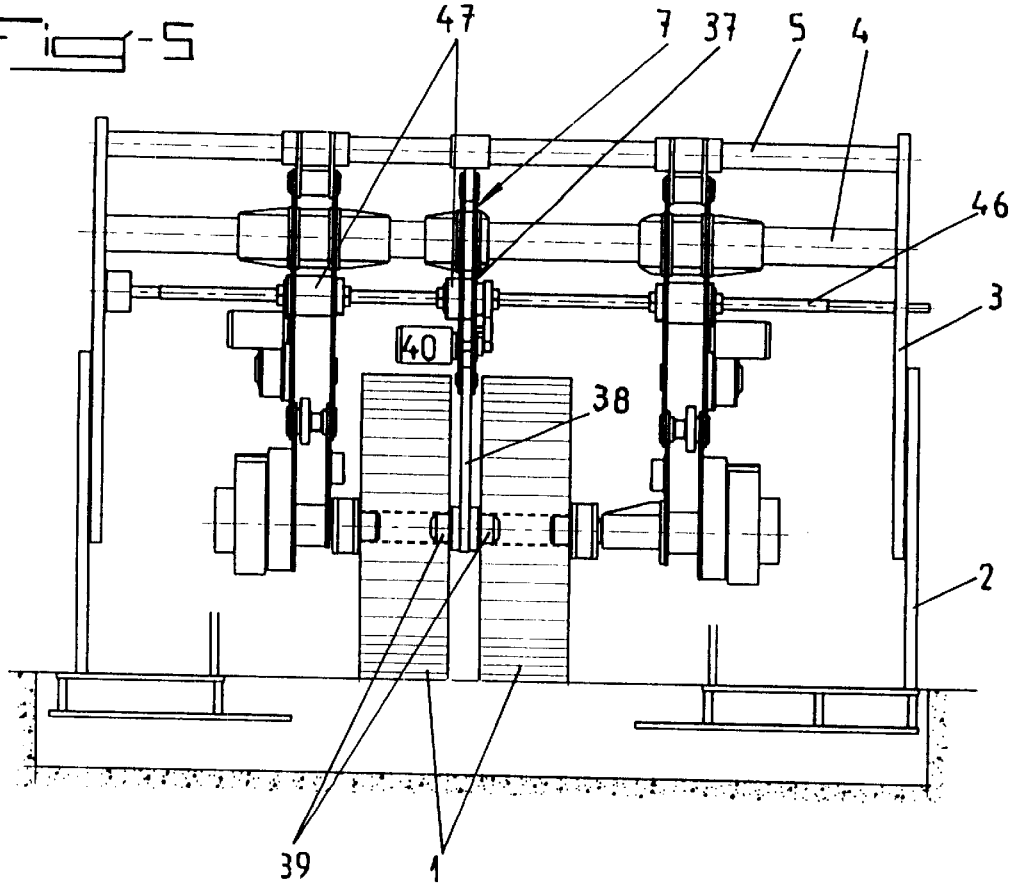
FIG. 5 is a front elevational view of the unrolling machine in position of gripping two side-by-side or coaxial bobbins.
Figure 6:
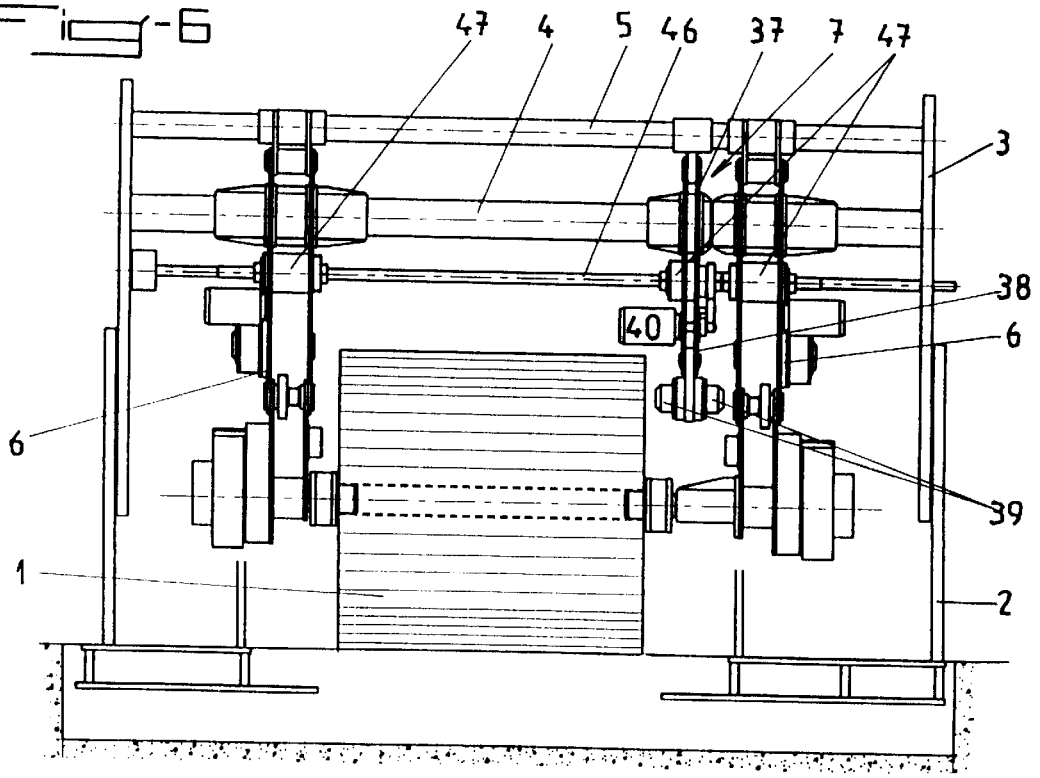
FIG. 6 is a view analogous to that of FIG. 5 showing the machine in gripping a single bobbin, the intermediate bobbin-carrying arm being retracted.

According to another characteristic of the invention, the motorized screw 47 for displacement of the arm 7 is provided with a device for synchronizing its displacement, in its retracted position, with the displacement of the lateral bobbin-carrying arm against which it is retracted. Such a device can for example be in the form of an electrical contact closed or opened by the arm 7 in its retracted position and controlling the actuation of a relay for the synchronization of starting the motorized screws, during displacement of the corresponding arms 6. Such a retracted position is shown in FIG. 6 of the accompanying drawings. For individual manipulation of the arms 7, the operation of the synchronization device can be manually cancelled. The arm 7 is then displaced in its service position by means of its motorized screw 47, for example for the engagement of one of its centering heads 37 in the mandrel of a bobbin of small width, before emplacement of the corresponding lateral arm (FIG. 5).

Thanks to the invention, it is therefore possible to provide an unrolling machine permitting the unrolling of two coaxial or side-by-side bobbins simultaneously and adaptable to the unrolling of a single bobbin by simple actuation of the support 15.

Moreover, the lateral bobbin-carrying arms 6 and intermediate bobbin-carrying arms 7 permit a direct pickup of the bobbins, the arms 6 having moreover a rigidity such that they are adapted to raise the heaviest loads.

Of course, the invention is not limited to the embodiment described and shown in the accompanying drawings. Modifications remain possible, particularly as to the construction of the various elements or by substitution of technical equivalents, without thereby departing from the scope of protection of the invention.

What is claimed is:

1. Unrolling machine permitting simultaneous unrolling, continuously, of two coaxial bobbins (1), comprising a frame (2) on which are guided in rotation two plates or discs (3) parallel to each other and connected by means of shafts (4 and 5) for the support and guidance of lateral bobbin-carrying arms (6) for the support and driving of bobbins (1) and an intermediate bobbin-carrying arm (7) for the simultaneous unrolling of two coaxial bobbins (1), said frame (2) being moreover provided with a device (8) for cutting and interconnecting ending strips and new bobbins, wherein the intermediate bobbin-carrying arm (7) comprises a first part (37) and a second part (38) articulated to one another, and is retractable to a non-use position and wherein the device (8) for cutting and connecting between ending strips and new bobbins comprises means (12) for the individual application of two ending strips, independently of each other, onto two new coaxial bobbins (1) and for application (13) of a single strip of greater width to a new single bobbin (1), as well as means (14) for selectively cutting and connecting one of two strips individually and independently and a single strip of greater width.

2. Machine according to claim 1, wherein the means (12) for individual application of two ending strips, independently of each other, onto the two new coaxial bobbins (1) and for application (13) of a single strip of greater width to a new single bobbin are mounted symmetrically in a rotatable support assembly (15) guided between the lateral support arms (9) by means of hubs (16) and actuated in rotation by a device (17), indexing means (18) for maintaining the rotatable support assembly (15) in service positions.

3. Machine according to claim 2, wherein the rotatable support assembly (15) is constituted by two plates (15') secured each to a hub (16) and interconnected by a pair of transverse members (15") disposed symmetrically relative to the hubs (16) for guidance in rotation of said rotatable support assembly (15) on the lateral support arms (9).

4. Machine according to claim 2, wherein the device (17) for actuating in rotation is constituted by at least one jack provided on its piston rod with a rack (19) coacting with a pinion (20) provided on the corresponding hub (16), said jack being mounted by its cylinder on the corresponding lateral support arm (9).

5. Machine according to claim 2, wherein the device (17) for actuation in rotation is constituted by a motor reductor assembly, a rotatable jack connected directly to the hub (16) and mounted on the corresponding lateral support arm (9).

6. Machine according to claim 2, wherein the means (18) for indexing is in the form of a bolt mounted on the internal surface of at least one of the lateral support arms (9) and coacting with holes (21) of corresponding cross section provided in the corresponding plate (15') of the rotatable support assembly (15).

7. Machine according to claim 6, wherein the indexing means (18) comprises two holes (21) diametrically opposed on the plate (15').

8. Machine according to claim 1, wherein the means (12) for individual application of the two ending strips, independently of each other, on two new coaxial bobbins (1) is constituted by two cylinders (22) each mounted at the end of two interconnected pivoting levers (23), at the end opposite to the cylinders (22), by means of a sleeve (24) for guidance and pivoting on a shaft (25) secured at its ends to the plates (15') of the rotatable support assembly (15) and by at least one means (26) for pivotally actuating each cylinder (22) individually, acting on at least one lever (23) of each pair of pivoting levers (23).

9. Machine according to claim 1, wherein the means (13) for application of a single strip of greater width to a single new bobbin is in the form of a single cylinder (27) having ends, said single cylinder being guided between its ends by two levers (28), mounted pivotally on a shaft (29) having two ends, said shaft being secured at its ends to the plates (15'), by means of a sleeve (30) interconnecting said levers (28) at their end opposite to that carrying the single cylinder (27), and means (31) for actuating pivotally the single cylinder (27) acting on at least one pivoting lever (28).

10. Machine according to claim 9, wherein the means (26 and 31), respectively for actuation pivotally of each cylinder (22) individually and actuation pivotally of the single cylinder (27), are in the form of jacks, whose piston rod is articulated on the corresponding lever (23 or 28) in an eccentric manner relative to the corresponding pivotal guide shaft (25 or 29) and whose cylinder is mounted on a cross piece (15") of the rotatable support (15).

11. Machine according to claim 1, wherein the means (14) for cutting and connection of two strips individually and independently or of a single strip of greater width are comprised by two transverse knives (32) mounted pivotally on a transverse shaft (33) whose ends are secured on the lateral support arms (9), for pivoting on the chassis (2), and by a pivoting actuator (34) for each individual knife (32).

12. Machine according to claim 11, wherein the knives (32) each extend over half the maximum width of strip which can be unrolled and are each mounted on the transverse shaft (33) for pivoting by means of arms (35), of which those situated on the side of the lateral support arm (9) are each connected to an independent pivoting actuator (34) in the form of a jack, the opposite arms (35) being adjacent, as well as the internal edges of the knives (32).

13. Machine according to claim 12, wherein the means (14) for cutting and connection are provided with a device (36) for locking said transverse knives (32) in alignment.

14. Machine according to claim 13, wherein the device (36) for locking the transverse knives (32) is in the form of a bolt actuated by a jack mounted on one of the adjacent arms (35), said bolt coacting in service position with a recess of corresponding shape on the other adjacent arm.

15. Machine according to claim 1, wherein the first part of the intermediate bobbin-carrying arm (7) is constituted by an element (37) for guidance on the shafts (4 and 5) for supporting and guiding the lateral bobbin-carrying arms (6) for support and driving the bobbins (1) and the second part is constituted by a pivoting lever (38) , articulated on said guide element (37) by one of its ends and having, on opposite sides of its free end, two centering heads (39) for insertion in the mandrels of bobbins.

16. Machine according to claim 15, wherein the element (37) for guidance on the shafts (4 and 5) for support and guidance of the lateral bobbin-carrying arms (6) for support and driving of the bobbins (1) is provided with locking means (40), respectively in the support position of the bobbins of small width and in the retracted position of the pivoting lever (38).

17. Machine according to claim 16, wherein the locking means (40) is constituted by a jack, mounted on the element (37) for guidance on the arms (4 and 5) for support and guidance of the lateral bobbin-carrying arms (6) and whose piston rod coacts, in its two service positions, with recesses (41) of corresponding shape provided in the pivoting lever (38), the retracted positions of the bobbin support being defined by an abutment (42) pivoting to two positions, actuated by a jack (42'), of the guide element (37) coacting with a fixed abutment (43) of the pivoting lever (38).

18. Machine according to claim 1, wherein the lateral bobbin-carrying arms (6) for support and driving the bobbins (1) as well as the intermediate bobbin-carrying arm (7) are mounted directly on one (4) of the support and guidance shafts, by means of their guide element (6' and 37), and are connected to the other guide and support shaft (5) by means of a mobile device (44) articulated by a pin (45) on the corresponding end of said guide element (6' and 37), a screw-threaded shaft (46) having two ends which are secured to the parallel plates (3), said screw-threaded shaft being guided moreover in said guide element (6' and 37) and coacting with a motorized screw (47) for displacement movements of the bobbin-carrying arms (6 and 7).

19. Machine according to claim 18, wherein the motorized screw (47) for manipulation of the movement of the intermediate bobbin-carrying arm (7) is provided with a device for synchronizing its displacement, in its retracted position, with the displacement of the lateral bobbin-carrying arm against which it is retracted.

* * * * *